US009923279B2

(12) United States Patent
Lipowski et al.

(10) Patent No.: US 9,923,279 B2
(45) Date of Patent: Mar. 20, 2018

(54) ANTENNA SYSTEM WITH SMALL MULTI-BAND ANTENNAS

(75) Inventors: Joseph Thaddeus Lipowski, Norwell, MA (US); James Alan Bingham, Westerville, OH (US)

(73) Assignee: Charter Communications Operating, LLC, St. Louis, MO (US)

( * ) Notice: Subject to any disclaimer, the term of this patent is extended or adjusted under 35 U.S.C. 154(b) by 0 days.

(21) Appl. No.: 13/585,652

(22) Filed: Aug. 14, 2012

(65) Prior Publication Data

US 2013/0207870 A1 Aug. 15, 2013

Related U.S. Application Data

(60) Provisional application No. 61/533,813, filed on Sep. 13, 2011.

(51) Int. Cl.

| | |
|---|---|
| ***H01Q 21/06*** | (2006.01) |
| ***H01Q 21/00*** | (2006.01) |
| ***H01Q 23/00*** | (2006.01) |
| ***H01Q 1/38*** | (2006.01) |
| ***H01Q 5/335*** | (2015.01) |

(52) U.S. Cl.

CPC ..... *H01Q 21/061* (2013.01); *H01Q 1/38* (2013.01); *H01Q 5/335* (2015.01); *H01Q 21/0006* (2013.01); *H01Q 23/00* (2013.01)

(58) Field of Classification Search

CPC ..... H01Q 21/0006; H01Q 23/00; H01Q 9/00; H01Q 21/06; H01Q 21/061; H01Q 21/062; H01Q 21/064; H01Q 21/065; H01Q 21/067; H01Q 21/068

USPC ..... 343/852, 745, 749, 850

See application file for complete search history.

(56) References Cited

U.S. PATENT DOCUMENTS

| | | | | |
|---|---|---|---|---|
| 3,235,868 | A * | 2/1966 | Wells | 343/727 |
| 6,606,069 | B2 * | 8/2003 | Kitamura et al. | 343/745 |
| 6,754,907 | B1 | 6/2004 | Schumacher et al. | |
| 7,725,912 | B2 | 5/2010 | Margulis | |
| 2002/0001337 | A1 * | 1/2002 | Chauncey et al. | 375/132 |
| 2002/0031224 | A1 | 3/2002 | Basawapatna et al. | |
| 2003/0139980 | A1 | 7/2003 | Hamilton | |
| 2003/0158913 | A1 | 8/2003 | Agnoli et al. | |

(Continued)

FOREIGN PATENT DOCUMENTS

| | | |
|---|---|---|
| EP | 1 231 674 A2 | 8/2002 |
| EP | 1 693 923 A2 | 8/2006 |

(Continued)

OTHER PUBLICATIONS

International Search Report dated Jan. 23, 2013 from counterpart International Application No. PCT/US2012/0548884, filed on Sep. 12, 2012.

(Continued)

*Primary Examiner* — Robert Karacsony

(74) *Attorney, Agent, or Firm* — Dunlap Codding, P.C.

(57) ABSTRACT

Multi-band antennae used for television reception of at least two different frequency bands enable multi-band reception with an electrically small antenna. The designs are applicable to individual antenna elements, two dimensional arrays, three dimensional arrays, and arrays constructed for high volumetric efficiency. By using the multi-band element, greater frequency reception is achieved with greater density possible in the antenna arrays.

12 Claims, 4 Drawing Sheets

(56) References Cited

U.S. PATENT DOCUMENTS

| | | | | |
|---|---|---|---|---|
| 2004/0117834 | A1 | 6/2004 | Karaoguz et al. | |
| 2004/0117846 | A1 | 6/2004 | Karaoguz et al. | |
| 2004/0193648 | A1 | 9/2004 | Lai et al. | |
| 2005/0062667 | A1 | 3/2005 | Shirosaka et al. | |
| 2005/0076375 | A1 | 4/2005 | Nakamura | |
| 2006/0174299 | A1 | 8/2006 | Watanabe et al. | |
| 2006/0259927 | A1 | 11/2006 | Acharya et al. | |
| 2006/0279469 | A1* | 12/2006 | Adachi et al. | 343/767 |
| 2007/0008236 | A1* | 1/2007 | Tillery et al. | 343/797 |
| 2007/0240192 | A1 | 10/2007 | Acharya et al. | |
| 2007/0276926 | A1 | 11/2007 | LaJoie et al. | |
| 2008/0059533 | A1 | 3/2008 | Krikorian | |
| 2008/0129864 | A1 | 6/2008 | Stone et al. | |
| 2009/0007190 | A1 | 1/2009 | Weber et al. | |
| 2009/0113492 | A1 | 4/2009 | Norin et al. | |
| 2009/0160720 | A1* | 6/2009 | Tsilioukas et al. | 343/744 |
| 2009/0172685 | A1 | 7/2009 | Shavit | |
| 2009/0268835 | A1 | 10/2009 | Imai et al. | |
| 2010/0060534 | A1* | 3/2010 | Oodachi | 343/745 |
| 2010/0125888 | A1 | 5/2010 | Jerram | |
| 2010/0240327 | A1 | 9/2010 | Lambrecht et al. | |
| 2010/0281042 | A1 | 11/2010 | Windes et al. | |
| 2011/0065412 | A1* | 3/2011 | Beffa | 455/326 |
| 2011/0140982 | A1* | 6/2011 | Ozden et al. | 343/852 |
| 2011/0164176 | A1* | 7/2011 | Raveendran et al. | 348/470 |
| 2012/0129479 | A1* | 5/2012 | Kanojia et al. | 455/230 |

FOREIGN PATENT DOCUMENTS

| | | | |
|---|---|---|---|
| EP | 1 734 659 | A1 | 12/2006 |
| EP | 1895777 | A1 | 3/2008 |
| JP | 2010273298 | | 12/2010 |
| WO | 2006014739 | A2 | 2/2006 |
| WO | 2006107350 | A1 | 10/2006 |
| WO | 2007064380 | A1 | 6/2007 |
| WO | 2009071132 | A1 | 6/2009 |
| WO | 2010030627 | A1 | 3/2010 |

OTHER PUBLICATIONS

International Search Report, dated May 3, 2012, from International Application No. PCT/US2011/061232, filed Nov. 17, 2011.

International Search Report, dated Aug. 7, 2012, from International Application No. PCT/US2012/025676, filed Feb. 17, 2012.

Boudier, T. et al., "VIDOS, a system for video editing and format conversion over the Internet," Computer Networks, vol. 34, 2000, pp. 931-944.

Wheeler, H. A., "Fundamental Limitations of Small Antennas," Proceedings of the IRE, vol. 35, Dec. 1947, pp. 1479-1484.

"Apple vs. Google: The Stakes are Rising," The Wall Street Journal, accessed on Feb. 10, 2012.

International Search Report, dated Nov. 2, 2012, from International Application No. PCT/US2012/025707, filed Feb. 17, 2012.

Partial International Search Report, dated Jun. 6, 2012, from International Application No. PCT/US2012/025658, filed Feb. 17, 2012.

International Preliminary Report on Patentability, dated Mar. 27, 2014, from counterpart International Application No. PCT/US2012/054884, filed on Sep. 12, 2012.

* cited by examiner

ANTENNA SYSTEM WITH SMALL MULTI-BAND ANTENNAS

RELATED APPLICATIONS

This application claims the benefit under 35 U.S.C. 119(e) of U.S. Provisional Application No. 61/533,813, filed on Sep. 13, 2011, which is incorporated herein by reference in its entirety.

BACKGROUND OF THE INVENTION

A common application for phased array antenna systems is steerable radar systems. Typically, the antenna elements of the steerable radar system are driven from a common source or connected to a common detection channel to produce a controlled emission or detection pattern. This enables the radar system to rapidly change the detection pattern to simultaneously track multiple targets, for example.

More recently, arrays of small radio frequency (RF) antennas have been used for capturing over the air content, such as broadcast television, and then streaming the captured content to users via a public network, such as the Internet.

An example of a system for capturing and streaming over the air content to users via the Internet is described in, "System and Method for Providing Network Access to Antenna Feeds" by Kanojia et al., filed Nov. 17, 2011, U.S. patent application Ser. No. 13/299,186, (U.S. Pat. Pub. No.: US 2012/0127374 A1), which is incorporated herein by reference in its entirety.

SUMMARY OF THE INVENTION

When capturing over the air content with arrays of antennas, it is important to maximize the number of antennas at the installation location. One way to maximize the number of antennas is to create a three dimensional array of antennas. The three dimensional array is created by implementing two dimensional arrays on antenna array cards, and then installing multiple antenna array cards in close proximity to create the three dimensional array.

One issue is that the three dimensional arrays of antennas often are installed in or on buildings or towers where there are size and/or weight limitations. Additionally, many of the arrays will be installed in large metropolitan cities where the cost of renting/leasing space for the arrays is expensive. Furthermore, there are often power consumption limitations at the installation locations. Reducing the size of each individual antenna and also the power consumption of the supporting circuitry for the arrays make the system less costly to deploy, maintain, and operate.

Another benefit of having an array with numerous small antennas is redundancy. If an antenna fails (or multiple antennas fail), then one of the other antennas is able to replace the non-functioning antenna without disrupting service.

The present invention is directed to antennas for the reception of radio waves preferably of at least two different frequency bands. More specifically, the purpose of the invention is to enable reception with electrically small antennas. This invention is applicable to individual antennas, two dimensional antenna arrays, three dimensional antenna arrays, and/or other antenna array systems constructed for high volumetric efficiency and/or density.

By implementing multi-band antennas, a wider frequency reception is achieved and a greater density of antennas is possible within the antenna array. Generally, the multi-band antennas are constructed from at least two electrically small loop antenna elements. Operation is based on the out of band impedance of the antenna elements. A tuning feed network is implemented with resistors, capacitors, varactors, inductors, or ferrite beads to control the tuning frequency of each antenna element. Additionally, each antenna is multiply resonant. This enables each antenna to have optimal performance and provide filtering of adjacent signals and/or avoid interference from signals that may be in the same band as the desired signal.

In general, according to one aspect, the invention features an antenna system comprising a circuit board having an antenna section and a tuner/demodulator section, an array of antennas installed on the antenna section that is controlled by and provides antenna feeds to tuners and demodulators in the tuner/demodulator section, and tuning feed networks for the antennas that connect the antennas to corresponding tuners and demodulators.

In general, according to another aspect, the invention features an antenna system for receiving television signals. The system includes an antenna element having a partial perimeter length of less than 4.3 centimeters and a tuning feed network for the antenna element.

In general, according to another aspect, the invention features an antenna system for receiving television signals. The antenna system comprising an antenna that includes at least a pair of antenna elements connected to a common pair of feed lines and a frequency tuning section for each antenna element of the antenna that receives tuning voltage via at least one of the feed lines.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
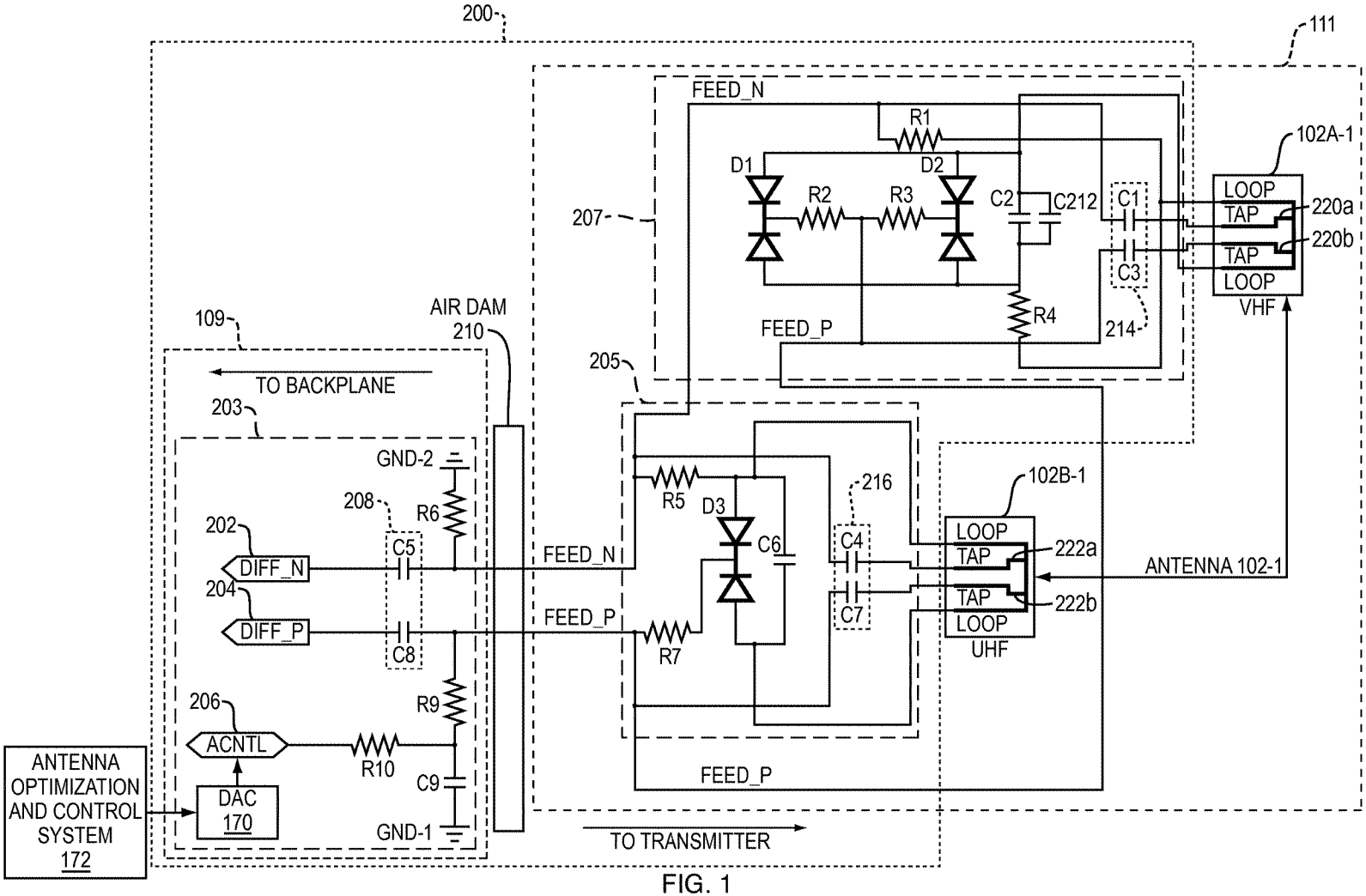
FIG. 1 is a circuit diagram of an antenna and tuning feed network for an antenna system.

FIG. 1 is a circuit diagram of a multi-band antenna 102-1 and tuning feed network 200 for an antenna system, which has been constructed according to the principles of the present invention.

In the illustrated circuit diagram, the multi-band antenna 102-1 is shown as a dual band antenna, which is also referred to as an antenna element pair. In the illustrated example, the antenna 102-1 further includes a low frequency antenna element 102A-1 and a high frequency antenna element 102B-1. In alternative embodiments, however, additional antenna elements could be implemented to form a tri-band antenna or a multi-band antenna with three or more antenna elements. In still other embodiments, the antenna is constructed from only a signal antenna element that covers both bands of interest or only a signal band.

In a typical implementation, the low and high frequency antenna elements 102A-1, 102B-1 are electrically small loop antennas. Loop antennas have an inductance that is proportional to the area carved out by the loops. Here, the antenna elements 102A-1, 102B-1 are rectangular. Other shapes such as circular shaped loop antennas known in the art could also be implemented. Electrically small antennas are defined for a particular wavelength lambda ($\lambda$) and radius "a" of the sphere enclosing an antenna. Then, if $4\pi a<\lambda$(4*pi* is less than lambda), the antenna is considered electrically small. See Wheeler, "Fundamental limitations of Small Antennas, Proceedings of the IRE, Vol. 35, Dec. 1947, pp 1479-1484.

Generally, the antenna 102-1 is multiply resonant. This enables the antenna 102-1 to have optimal performance at a wide range of frequencies and reject interference from other signals that may be in the same band as the desired signal.

In a current implementation, the antenna elements 102A-1, 102B-1 are each approximately 0.5 inches in height, 0.5 inches wide, or about 1.3 centimeters (cm) by 1.3 cm, and have a thickness of approximately 0.030 inches, or about a 1 millimeter (mm). In general, the three sided length (or partial perimeter) of the antenna elements 102A-1, 102B-1 is less than 1.7 inches (4.3 cm), with a total length of all 4 sides being less than 2.3 inches (5.8 cm).

In general, smaller antennas are preferable to achieve higher density, yet smaller antennas typically have a lower gain. As a result in other embodiments larger antennas/antenna elements are used, such as antennas/antenna elements with a total length of up to 20 cm, or even up to 50 cm or 100 cm, and possibly even larger understanding that there is a concomitant decrease in packing density.

A resonance of the antenna 102-1, and each antenna 102-1 to 102-*n*, is controlled via the tuning feed network 200. The tuning feed network 200 includes a radio frequency (RF) coupling and direct current (DC) injection section 203, a high frequency tuning section 205, and a low frequency tuning section 207.

In the illustrated example, the low frequency tuning section 207 and low frequency antenna element 102A-1 are designed to receive carrier signals in the VHF (Very High Frequency) range or 174 MHz to 216 MHz. The high frequency tuning section 205 and high frequency antenna element 102B-1 are designed to receive carrier signals in the UHF (Ultra High Frequency) range or 470 MHz to 700 MHz.

In a typical implementation, antennas (e.g., reference numerals 102-1 to 102-*n* in FIG. 2B) are grouped together on an antenna array card (reference numeral 152 in FIG. 2A) to form an antenna array (reference numeral 102 in FIG. 2A) of antennas. Each antenna 102-1 to 102-*n* within the antenna array 102 is tuned by a separate tuning feed network 200. Implementing a separate tuning feed network 200 for each antenna 102-1 to 102-*n* enables each antenna to be individually tuned to a different frequency.

Generally, the antennas (reference numerals 102-1 to 102-*n* in FIG. 2B) are balanced fed antenna elements. In alternative embodiments, however, the antennas 102-1 to 102-*n* are unbalanced fed antennas. In a preferred embodiment, the antennas 102-1 to 102-*n* are tunable antennas, but the antennas 102-1 to 102-*n* could also be fixed frequency antennas.

Returning to FIG. 1, an RF connection from the low frequency tuning section 207 to low frequency antenna element 102A-1 is made via capacitors C1 and C3. Capacitors C1 and C3 have a capacitance of 2.2 nanoFarads, and these capacitors form a DC block (low frequency tuning section DC block 214). A DC block is a frequency filter designed to filter out lower frequency signals and DC signals while allowing higher frequency RF signals to pass. Additionally, the low frequency tuning section DC block 214 prevents the low frequency antenna element 102A-1 from shorting out a tuning voltage sent from the RF coupling and DC injection section 203.

In alternative embodiments, the RF connection is made with band pass filters, high pass filters, diplexers and/or multiplexers.

Capacitors C1 and C3 connect to low frequency tap points 220*a*, 220*b* of the low frequency antenna element 102A-1. The low frequency tap points 220*a*, 220*b* are designed to present the desired impedance from the low frequency antenna element 102A-1 to the feed lines FEED_P, FEED_N. The location of the intersection of the low frequency tap points 220*a*, 220*b* with the low frequency antenna element 102A-1 and the area cut out between the tap structure contribute to the impedance transformation.

Capacitors C2 and C212 are in parallel with the varactor diode pairs D1 and D2. In the illustrated example, capacitor C2 has a capacitance of 15 picoFarads and capacitor C212 has a capacitance of 18 picoFarads. The varactor diodes pairs D1, D2 resonate with the inductance of the low frequency antenna element 102A-1 to set the tuning frequency. The bandwidth is determined by the value of resistor R4 along the parasitic resistances in the wire of the low frequency antenna element 102A-1 and the varactor diode pairs D1 and D2. Resistors R1, R2, and R3 provide high impedance connections for DC tuning voltages that are supplied on the feed line FEED_P to the varactor diode pairs D1 and D2. The high impedance serves two purposes. First, the high impedance provides isolation to the feed lines FEED_P, FEED_N so that RF signal is not lost. Second, the high impedance provides isolation from the varactor diode pairs D1 and D2 so they are not disrupted by other impedance/capacitive effects.

Referring to the high frequency tuning section 205, while there are some differences in the components used and their values, the basic functionality of the circuit is the same as the low frequency tuning section 207. For example, the high frequency antenna element 102B-1 is generally identical to the low frequency antenna element 102A-1 in a current embodiment. Additionally, capacitors C4 and C7 provide an RF connection from the high frequency antenna element 102B-1 to the high frequency tuning section 205. Likewise, capacitors C4 and C7 form a DC block (high frequency tuning section DC block 216). Capacitors C4 and C7 each have a capacitance value of 24 picoFarads (compared to 2.2 nanoFarads for C1 and C3). Resistor R7 and R5 provide a high impedance connection for the tuning voltages provided on feed line FEED_P to varactor diode pair D3. The parasitic resistances in the wire of the high frequency antenna element 102B-1 and the varactor diode pair D3 set the bandwidth. Lastly, high frequency tap points 222*a*, 222*b* are designed to present the desired impedance from the high frequency antenna element 102B-1 to the feed lines FEED_P, FEED_N.

The feed lines (FEED_N and FEED_P) connect the high frequency tuning section 205 and the low frequency tuning section 207 to the RF coupling and DC injection section 203. The feed lines (FEED_N, FEED_P) carry the received RF signal from the antenna elements 102A-1, 102B-1, to the RF coupling and DC injection section 203. In a typical implementation, the physical distance from the RF coupling and DC injection section 203 and the antenna elements 102A-1, 102B-1 can be relatively large. For example, in one embodiment the physical distance is twenty or more inches (approximately 0.5 meters). In alternative embodiments, however, the physical distance is only a few inches (e.g., approximately 5 to 8 centimeters).

The RF coupling and DC injection section 203 includes an analog control line (ACNTL) connection 206 and two logical interfaces: DIFF_N 202 coupled with DIFF_P 204. The two logical interfaces DIFF_N 202, DIFF_P 204 are differential radio frequency connections that carry received carrier signals to a receiver (or tuner) and demodulator (reference numerals 104-1 and 106-1 in FIG. 2A) that are located on an antenna array card (reference numeral 152 in FIG. 2A). The ACNTL connection 206 is a single-ended analog control line that is referenced to ground (e.g., GND-1) and provides the control signal, to tune the varactor diode pairs D1, D2, D3. In the current embodiment, the control signal is a tuning voltage. In the illustrated embodiment, the control signal from the ACNTL connection 206 is generated by an antenna optimization and control system 172. The control signal from the antenna optimization and control system 172 is converted to a voltage by a digital to analog converter 170. A common tuning voltage is provided to the low and high frequency tuning sections 205, 207 and the antenna elements 102A-1, 102B-1.

In an alternative embodiment, the control signal could be a differential control signal. In this embodiment, another input control signal is injected at GND-2 and connected at the end of resistor R6 (GND-2 would be removed/replaced).

Capacitors C5 and C8 are blocking capacitors and form a DC block (RF coupling and DC injection DC block 208). The RF coupling and DC injection DC block 208 provides the ability to superimpose the control signal from ACNTL connection 206 on the same feed line (FEED_P) as the received carrier signals from the low and high frequency antenna elements 102A-1, 102B-1.

Typically, when creating a multi-band antenna, two or more antenna elements are put in parallel. There are several important factors to account for when combining multiple antenna elements. For example, in band (where the antenna is tuned), the impedance as measured at the low frequency tap points 220A, 220B will look like a single pole bandpass (complex pole-pair) filter having a desired impedance at the resonant frequency. Below the tuned frequency, the impedance will look like a short circuit. Above the tuned frequency, the impedance will approach an open circuit. When implementing the low frequency tuning section DC block 214, the low frequency tuning section 207 approaches an open circuit at higher frequencies.

Because the low frequency antenna element 102A-1 looks like an open circuit when the tuning feed network 200 is operating at higher frequencies, the low frequency tuning section 207 is typically able to connect to the high frequency tuning section 205 without issue. However, the high frequency antenna element 102B-1 looks like a short circuit when the tuning feed network 200 is operating at lower frequencies. To protect the low frequency antenna element 102A-1 when operating at lower frequencies, high frequency tuning section DC block 216 is used to electrically open the high frequency antenna element 102B-1.

In alternative embodiments, different capacitors values are able to be implemented for the high frequency tuning section DC block 216. In the illustrated example, the 24 picoFarad capacitor is selected. Similar design considerations are applied when combining additional antennas elements to create tri-band or multi-band antenna elements with, for example, three or more loop antennas.

Figure 2A:
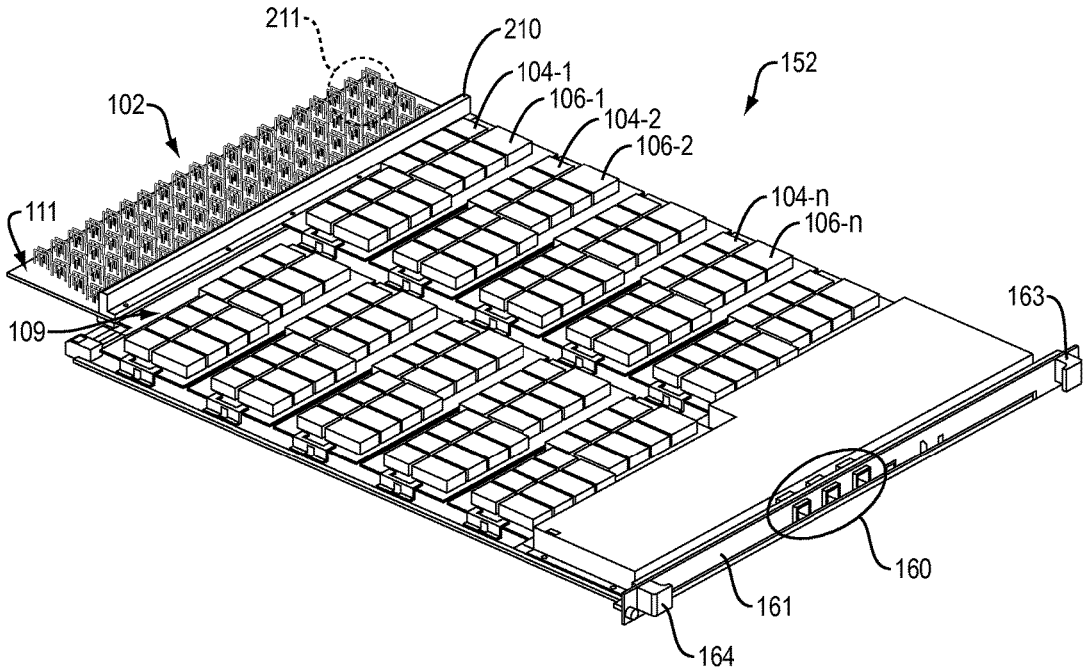
FIG. 2A is a perspective view of the antenna system implemented on a circuit board (antenna array card) and illustrates how antenna elements, tuners, and demodulators are mounted.

FIG. 2A is a schematic perspective diagram illustrating how the antenna array 102, the tuners 104-1 to 104-*n*, and the demodulators 106-1 to 106-*n* are mounted on the antenna array card 152 on which the antenna system is implemented.

Figure 2B:
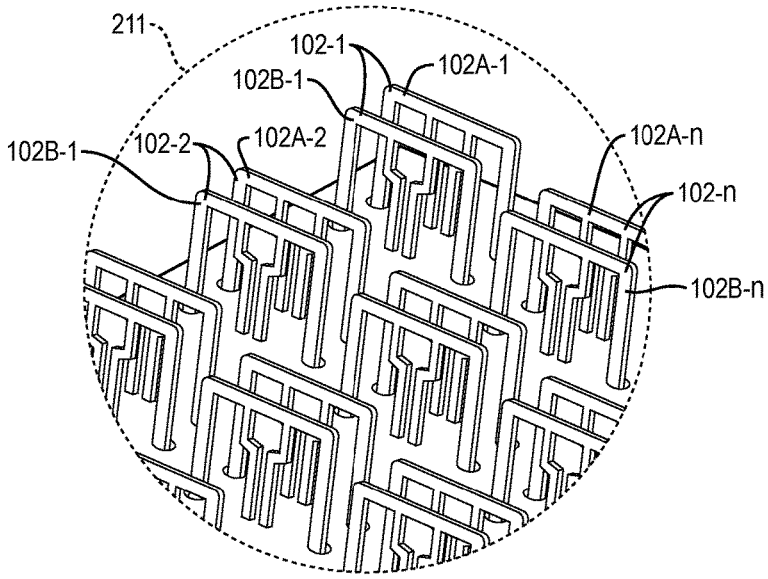
FIG. 2B is a perspective view showing a magnified view of antenna elements of the antenna system.

The antenna array 102 is mounted on the antenna array card 152 to form a two dimensional array of antennas (reference numerals 102-1 to 102-*n* in FIG. 2B). In one implementation, each array 102 includes 80 antennas (for a total of 160 antenna elements). In alternative embodiments, however, the antenna array card 152 is able to hold more as many as 320 antennas (for a total of 640 antenna elements), possibly 640 antennas (for a total of 1,280 antenna elements), or more. When increased numbers of antennas are implemented on the antenna array card 152, a selector switch (not shown) is generally included on the antenna array card to selectively connect the antennas (102-1 to 102-*n* in FIG. 2B) to an available tuners and/or demodulators from a pool of available resources on the antenna array card 152. The selector switch enables additional antenna elements to be added to the array 102 without requiring additional tuners and/or demodulators.

The array 102 is mounted on an antenna section 111 of the antenna array card 152. The antenna array card is typically a circuit board for mounting electronic components such as antenna elements, tuners, demodulators, and feed lines, to list a few examples.

Each antenna (reference numerals 102-1 to 102-*n* in FIG. 2B) of the array 102 is controlled by a corresponding tuning feed network (reference numeral 200 in FIG. 1). Each tuning feed network 200 is connected to a corresponding tuner 104-1 to 104-*n* and demodulator 106-1 to 106-*n*. Antenna feeds from the antennas (102-1 to 102-*n* in FIG. 2B) are sent to the corresponding tuners 104-1 to 104-*n* and demodulators 106-1 to 106-*n*. Generally, the tuners 104-1 to 104-*n* and demodulators 106-1 to 106-*n* are mounted on a tuner/demodulator section 109 of the antenna array card 152.

In the illustrated implementation, the tuners 104-1 to 104-*n* are ATSC (Advanced Television Systems Committee) tuners. The tuners 104-1 to 104-*n* convert received radio frequency signals to a much lower, fixed intermediate frequency signal that the demodulators 106-1 to 106-*n* are able to demodulate. The demodulators 106-1 to 106-*n* recover synchronization and decode the signal to MPEG-2 format because it is currently a standard format for the coding of moving pictures and associated audio information. In alternative embodiments, the signal could be decoded to other audio/video formats known in the art.

Typically, the antenna array card 152 is fabricated from a dielectric insulator material. The components are mounted to the antenna array card 152 and are connected via conductive pathways (or tracks). In one embodiment, the antenna array card is approximately 25 inches wide by 21 inches long, or about 0.6 meters (m) by 0.5 m.

An air dam 210 divides the antenna section 111 and the tuner/demodulator section 109. Additionally, the air dam 210 acts as part of a Faraday shield to prevent unwanted interference from the components on the tuner/demodulator section 109 leaking and interfering with the antenna section 111 (and vice versa). Additionally, the air dam 210 acts to constrain airflow to enable adequate cooling of the integrated circuits such and components (e.g., 104-1 to **104-*n* and 106-1 to 106-*n***).

A data link connector 160 is installed in a card base plate 161, which is typically formed on the antenna array card 152. The data link connector 160 takes the demodulated signals from the demodulators 106-1 to **106-*n* and pushes them to the remainder of the encoder system (reference numeral 103 in FIG. 3) that is typically located in a more convenient location such as basement or ground level building, which does not require access to RF signals. The antenna array card 152 further includes locking tabs 163, 164** to enable the cards to be fastened within an enclosure.

Referring back to FIG. 1, the RF coupling and DC injection section 203 is located in the tuner/demodulator section 109 of the PCB 152. The low and high frequency tuning sections (205, 207 in FIG. 1) are located adjacent to the corresponding low and high frequency antenna elements 102A-1, 102B-1 in the antenna section 111 of the antenna array card 152. While most of the components of the tuning feed networks can be mounted on either side of the antenna array card 152, the antennas 102-1 to **102-*n* are typically all mounted on the same side of the antenna array card 152**.

FIG. 2B is a schematic perspective diagram showing a magnified view of section 211 and the antennas 102-1 to **102-*n*, which include antenna elements (e.g., 102A-1, 102B-1, 102A-2, 102B-2 . . . 102**A-*n*, 102B-*n*).

The antennas 102-1 to **102-*n* in the illustrated example are pairs of rectangular shaped loop antenna elements 102A, 102B. The antennas 102-1 to 102-*n* are arranged create a two dimensional matrix (or array) on the antenna array card (152 in FIG. 2A). In the current implementation, the rows of antennas 102-1 to 102-*n* are offset to create a staggered two dimensional matrix. The staggered matrix helps with routing of the feed lines on the antenna array card (reference numeral 152 in FIG. 2**A).

Figure 3:
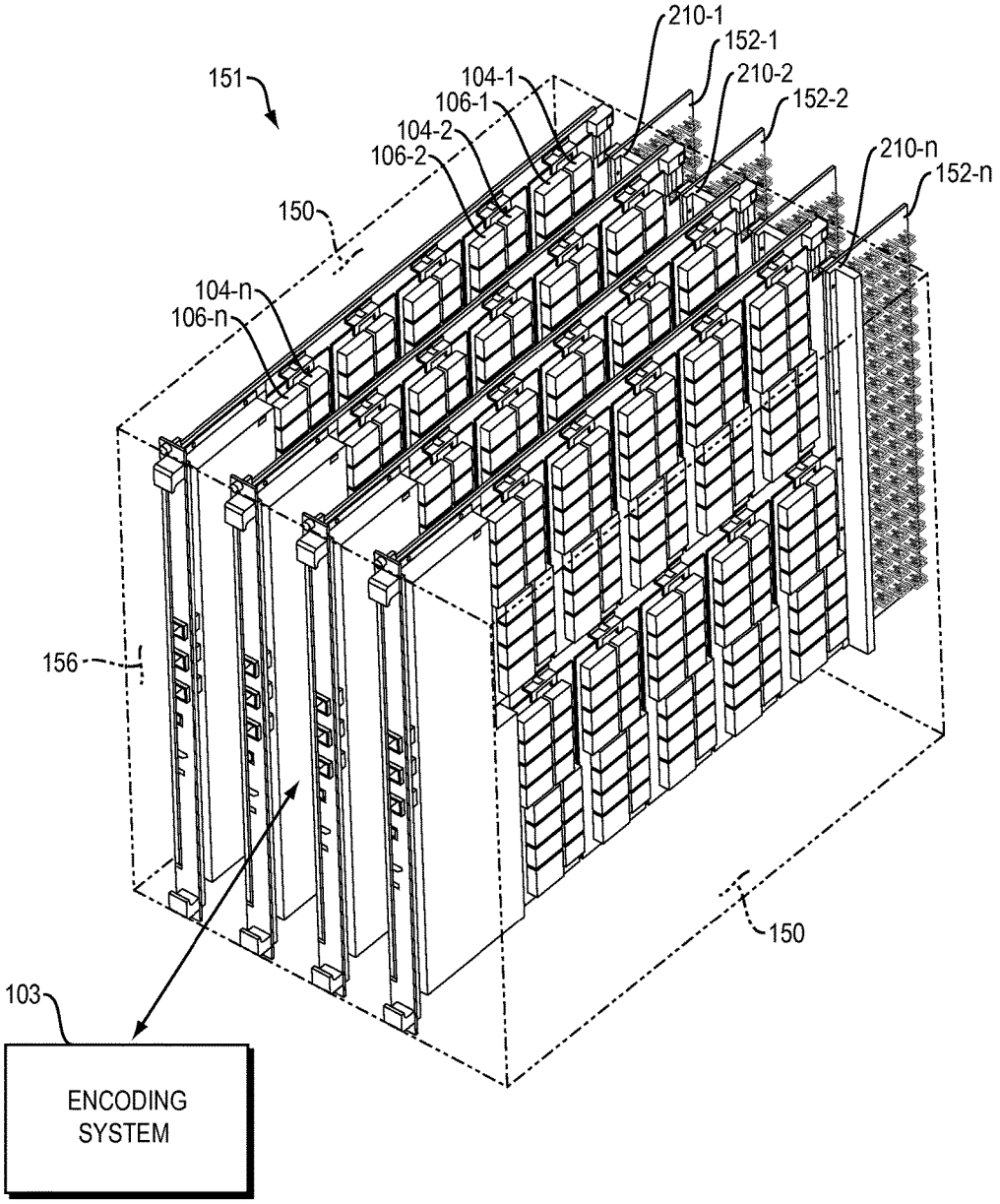
FIG. 3 is a schematic perspective view of a card cage structure shown in phantom, which functions as an enclosure for the antenna array cards to create a three dimensional antenna array.

FIG. 3 is a schematic perspective view of a card cage structure 151, which is shown in phantom. The card cage structure 151 functions as an enclosure for the antenna array cards 152-1 to **152-*n*** to create an antenna system with a three-dimensional array of antennas.

The side, top, bottom and front walls 150 of the card cage structure 151 are fabricated from a conductive material to maximize Faraday shielding of the antenna elements from the active electronics. The front wall of the card cage provides an open port as the boresight of the antenna array and faces the transmitting antennas. The rear wall 156 includes data transport interfaces that connect to an encoder system 103.

The encoder system 103 is typically located in a basement or ground level building and is comprised of encoding components such as transcoders, computer servers, and storage devices. In a typical implementation, demodulated signals from demodulators 106-1 to **106-*n* are transmitted to transcoders (not shown) of the encoding system 103**. The transcoders transcode the demodulated signals to transcoded content in real time. Typically, the transcoders transcode into MPEG-4 format (also known as H.264), but the transcoders could transcode the demodulated signals into other formats in alternative embodiments. The transcoded content is then indexed and stored in the storage devices and/or streamed to client devices via the Internet.

Within the card cage structure 151, the antenna array boards 152-1 to **152-*n* are generally spaced about an inch (2.5 centimeters) apart within the enclosure. This distance enables a relatively high density for the antenna array cards 152-1 to 152-*n***, while reducing unwanted interference between antenna elements to acceptable levels. This configuration helps to further maximize Faraday shielding of the antennas from the active electronics on the antenna array cards.

In a typical implementation, the air dams 210-1 to **210-*n* act to block the airflow for the antenna array cards 152-1 to 152-*n* and fill in the gap between the cards such that the air dam of each card engages the backside of its adjacent card. Additionally, the air dams 210-1 to 210-*n* also act as part of the Faraday shields to reduce interference between the components (e.g., 104-1 to 104-*n* and 106-1 to 106-*n*) and the antennas. Typically, the antenna array cards 152-1 to 152-*n* are orientated vertically, with the antenna elements horizontal to create a horizontally polarized (Electric Field) half omni-directional antenna array. Additionally, the antennas protrude out of the front of card cage 151** to further help reduce interference between the components and the antennas.

Alternatively, if over the air content from the broadcasters has a vertical polarization, which occurs in some locales, then orientation of the antenna array cards 152-1 to **152-*n*** and antennas should be changed accordingly. The illustrated example shows the orientation of the antennas for broadcasters with horizontal polarization.

Figure 4:
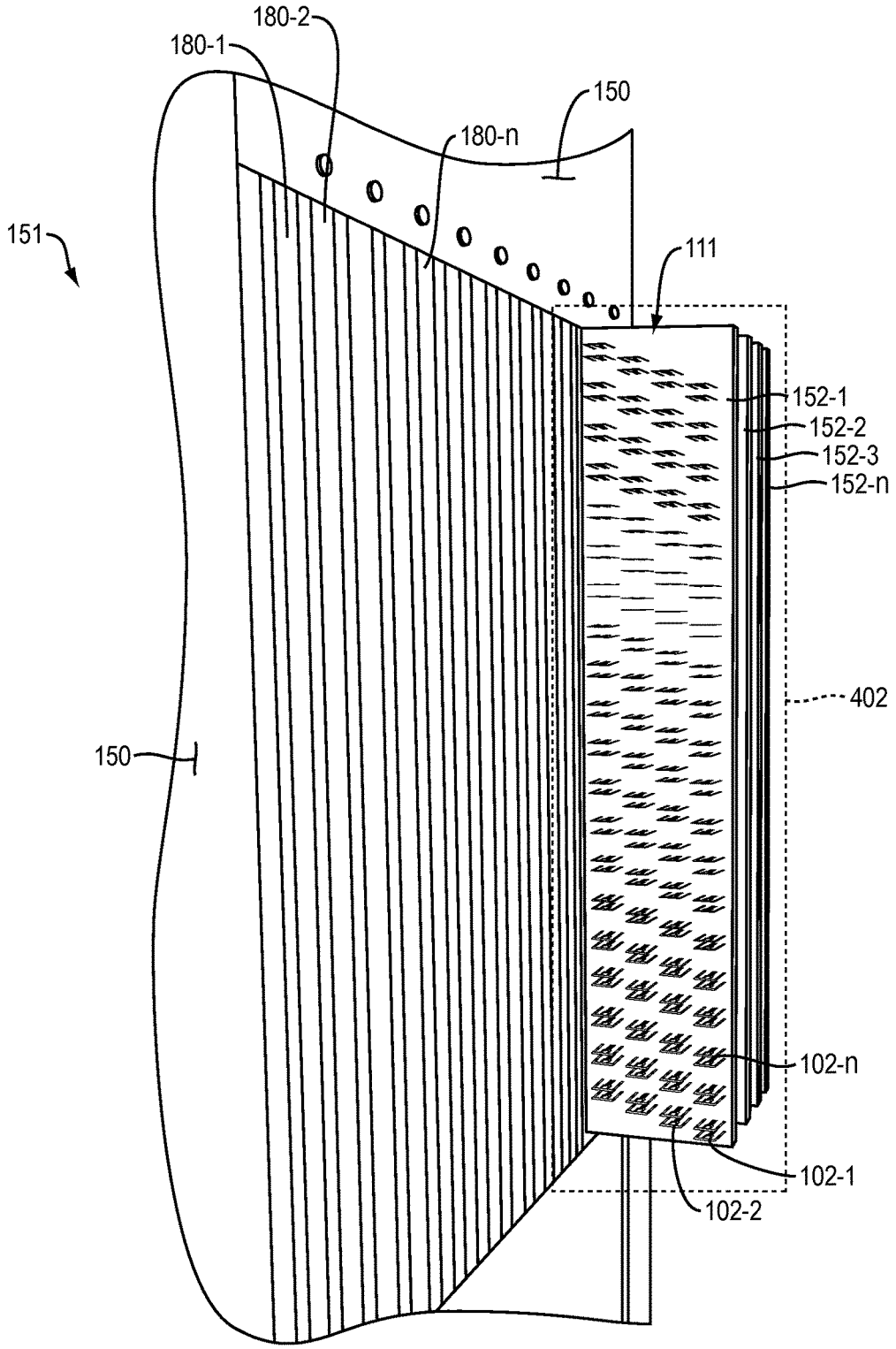
FIG. 4 is a perspective view of the card cage structure that illustrates how the antennas mounted on antenna array cards protrude out of the card cage and create a three dimensional antenna array.

FIG. 4 is a partial perspective view of the front of the card cage structure 151 that illustrates how the antennas 102-1 to **102-*n* protrude out of the card cage 151**.

In the illustrated example, multiple antenna array cards 152-1 to **152-*n* are installed in the card cage structure 151 and orientated in a vertical position. While only four antenna arrays cards are shown in the illustrated example, the card cage structure 151 is capable of housing between 8 and 32 antenna array cards (or more). If the card cage structure 151 is not filled to capacity, then blank slot cards 180-1 to 180-*n*** are installed to fill the empty slots of the card cage structure.

When antenna array cards 152-1 to **152-*n* (and antennas) protrude from the card cage structure 151, a three dimensional array of antennas 402** is created.

In some embodiments, multiple card cage structures are housed together in rack mounted chassis (not shown) to further increase the density of antenna array cards where the card cage structures are installed.

While this invention has been particularly shown and described with references to preferred embodiments thereof, it will be understood by those skilled in the art that various changes in form and details may be made therein without departing from the scope of the invention encompassed by the appended claims.

What is claimed is:

1. An antenna system comprising:

a single circuit board having an antenna section and a tuner/demodulator section;

an array of antennas installed on the antenna section of the single circuit board, the array of antennas controlled by and provides antenna feeds to tuners and demodulators in the tuner/demodulator section of the single circuit board; and tuning feed networks for the antennas on the single circuit board that connect the antennas to corresponding tuners and demodulators, wherein the tuning feed networks connect to the tuners and demodulators in the tuner/demodulator section via feed lines in which a tuning voltage is superimposed on at least one of the feed lines by a control line to enable tuning via the tuning feed networks, wherein the array of antennas and the tuners and demodulators are located on the same side of the single circuit board.

2. The antenna system according to claim 1, wherein the tuning feed networks are connected to the antennas with high pass filters.

3. The antenna system according to claim 1, wherein the tuning feed networks are connected to the antennas with diplexers or multiplexers.

4. The antenna system according to claim 1, wherein the tuning feed networks include a radio frequency coupling and direct current injection section and a tuning section.

5. The antenna system according to claim 4, wherein components of the tuning feed networks are located adjacent to corresponding antennas in the antenna section of the circuit board.

6. The antenna system according to claim 4, wherein the radio frequency coupling and direct current injection section is located in the tuner/demodulator section of the circuit board.

7. The antenna system according to claim 1, wherein the tuning feed networks include direct current blocks to filter out direct current.

8. The antenna system according to claim 1, wherein the tuners include Advanced Television Systems Committee (ATSC) tuners.

9. The antenna system according to claim 1, wherein the antennas are balanced fed antennas.

10. The antenna system according to claim 1, wherein the antennas are unbalanced fed antennas.

11. The antenna system according to claim 1, wherein the array of antennas are offset to create a staggered matrix of antennas.

12. An antenna system comprising:

a single circuit board having an antenna section and a tuner/demodulator section;

an array of antennas installed on the antenna section of the single circuit board that is controlled by and provides antenna feeds to tuners and demodulators in the tuner/demodulator section of the single circuit board; and tuning feed networks for the antennas on the circuit board that connect the antennas to corresponding tuners and demodulators, wherein the tuning feed networks connect to the tuners and demodulators in the tuner/demodulator section via feed lines in which a tuning voltage is superimposed on at least one of the feed lines by a control line to enable tuning via the tuning feed networks, and wherein the demodulators connect to the feed lines with high pass filters and wherein the tuners are Advanced Television Systems Committee (ATSC) tuners, the tuning feed network adjusting tuning frequency of the antennas on the circuit board, wherein the array of antennas and the tuners and demodulators are located on the same side of the single circuit board.

* * * * *